United States Patent [19]

Gustavsson

[11] 4,130,973

[45] Dec. 26, 1978

[54] BUILDING BLOCK

[75] Inventor: Stig O. S. Gustavsson, Linkoping, Sweden

[73] Assignee: Curt Holger Ingeström, Alvangen, Sweden

[21] Appl. No.: 831,184

[22] Filed: Sep. 7, 1977

[51] Int. Cl.[2] ..... E04C 1/40; E04C 1/06

[52] U.S. Cl. ..... 52/309.17; 52/405

[58] Field of Search ..... 52/404, 405, 309.4, 52/309.13, 309.17

[56] References Cited

U.S. PATENT DOCUMENTS

| | | | |
|---|---|---|---|
| 3,546,833 | 12/1970 | Perreton | 52/405 X |
| 3,922,413 | 11/1975 | Reineman | 52/405 X |
| 4,002,002 | 1/1977 | Barnhardt | 52/405 |
| 4,016,693 | 4/1977 | Warren | 52/404 |
| 4,018,018 | 4/1977 | Kosuge | 52/404 |

FOREIGN PATENT DOCUMENTS

| | | | |
|---|---|---|---|
| 2307096 | 11/1976 | France | 52/405 |
| 1252562 | 11/1971 | United Kingdom | 52/405 |

*Primary Examiner*—J. Karl Bell

*Attorney, Agent, or Firm*—Finnegan, Henderson, Farabow & Garrett

[57] ABSTRACT

In a building block of cement-stabilized elastic granulate there are provided blind holes which are filled with a heat-insulating material.

4 Claims, 6 Drawing Figures

BUILDING BLOCK

The invention relates to a building block of cement-stabilized elastic granulate, particularly light-weight clinker, i.e. burnt expanded clay, having parallelepipedic form.

When a solid building block of light-weight clinker is formed in a mould there is obtained an increase of the outside measures of the block as it is separated from the mould, due to the fact that the building block must be formed under pressure on the material of which the block is being made, the material at the same time being vibrated, and, moreover, due to the fact that the individual light-weight clinker granules do not have one and the same elasticity. The increase of the outside measures thus obtained is combined with production of stresses in the block which are believed to be one of the reasons for the tendency of solid blocks to crack.

It is a primary object of this invention to provide a new and improved building block of the kind referred to.

It is a further object of this invention to provide a new and improved building block which eliminates the drawbacks discussed above.

A still further object of the invention is to provide a new and improved cement-stabilized light-weight clinker building block having improved high-quality thermal insulation properties.

A still further object of the invention is to provide a new and improved cement-stabilized light-weight clinker building block having optimum bearing strength at a favourable relationship between weight and strength which means that the block is easier to handle and ship and that it can be produced of a less amount of granulate than solid blocks.

Yet another object of this invention is to provide a new and improved cement-stabilized light-weight clinker building block which provides a good adhesion to adjacent blocks when used for building brickworks.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the foregoing objects and in accordance with the purpose of the invention, as embodied and broadly described herein, a building block of the kind referred to above comprises a parallelepipedic body of cement-stabilized elastic granulate formed with blind holes extending into the block from a surface thereof, which is intended to be the lower side of the block when in operative position, perpendicularly to said surface, said holes being arranged in several rows each of which comprises a plurality of spaced holes, and heat insulating material filled into said holes.

In the building block of the invention high stress in the block mass are relieved when cores used in the mould for forming the holes are withdrawn from the block, i.e., the stresses are relieved by displacement of material or expansion of the material mass towards the holes in the block such that there is obtained no increase of the outside measures of the block and no production of stresses in the block during the following separation of the block from the confining mould.

Preferably the blind holes are filled with a substantially rigid foamed urea-formaldehyde resin.

Prior art building blocks of different materials have been formed with holes of varying configuration as is illustrated by Swedish Pat. Nos. 54,507, 126,503 and 140,341 and German Pat. No. 880,928 but the building blocks according to said patent specifications are made of other materials than elastic granules such as light-weight clinker and thus do not present the specific problems discussed above which are specific for blocks of light-weight clinker material. In prior art building blocks according to the said patent specifications holes are arranged but the pattern and form of such holes are not as proposed according to the invention in order to obtain a favourable relationship between weight and strength of the block and above all no heat insulating material is filled into the holes in order to obtain high-quality heat insulation properties of the block.

Thus, according to the invention it is essential that the building block is made of cement-stabilized elastic granulate and that blind holes are arranged therein and filled with heat-insulating material as described above. This combination of material and holes has not been proposed before, and therefore, is considered to be quite unique and novel in the art.

The accompanying drawings, which are incorporated in and constitute a part of this specification, illustrate embodiments of the invention and, together with the description, serve to explain the principle of the invention.

Reference will now be made in detail to the present preferred embodiments of the invention, examples of which are illustrated in the accompanying drawings.

Figure 1:
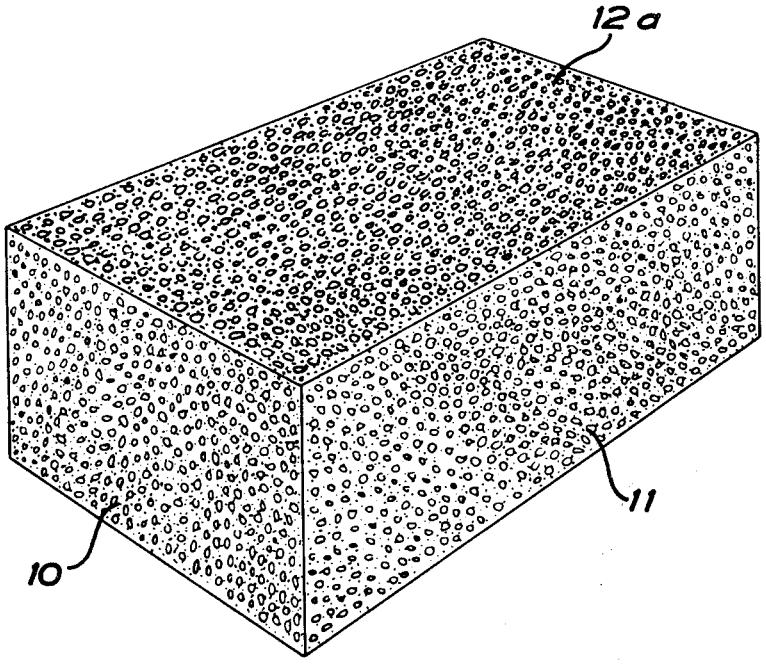
FIG. 1 is a perspective view of the block in operative position.
Figure 2:
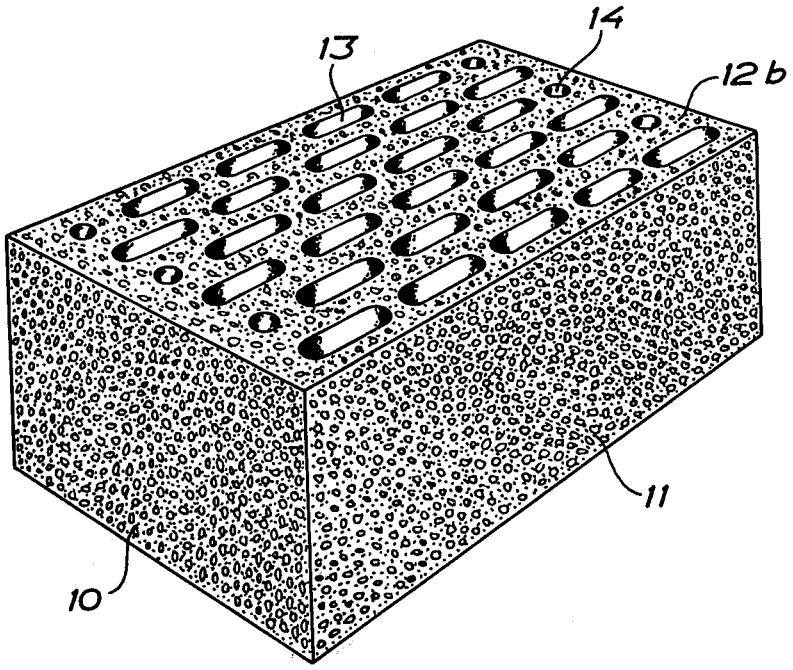
FIG. 2 is a corresponding perspective view of the block as seen from the lower side thereof.
Figure 3:
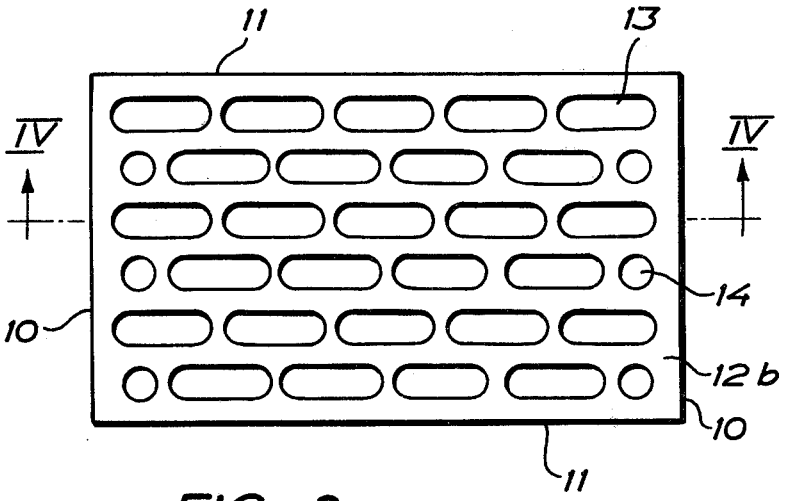
FIG. 3 is a plan view of the lower side of the block.
Figure 4:
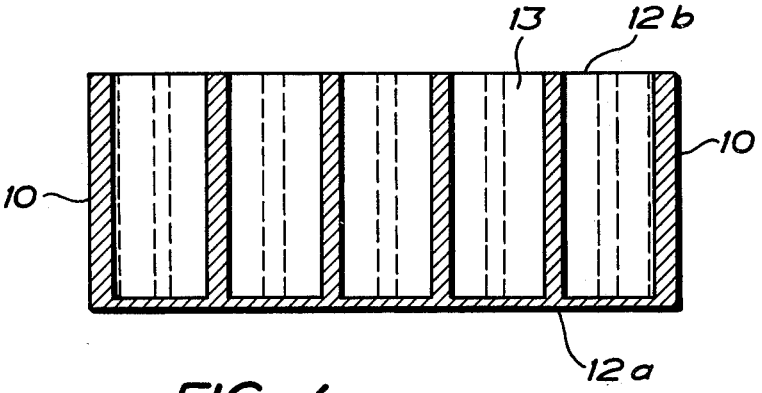
FIG. 4 is a cross sectional view taken along line IV—IV in FIG. 3.

The building block disclosed in the drawings is manufactured in a conventional manner as a parallelepipedic body of cement-stabilized light clinker, i.e. burnt expanded clay, with short sides 10, long sides 11 and flat sides **12*a* and 12*b*. One of the flat sides, 12*a*, which can be seen in FIG. 1 is intended to be the top side of the block in the operative position of the block while the other flat side 12*b* which can be seen in FIG. 2 accordingly is intended to be the lower side of the block. In the flat side 12*b* there are provided a number of elongated holes 13 which extend from said side perpendicularly into the block and terminate closely to the top side 12*a* as will be seen in FIG. 4. Thus, the holes 13 are blind holes and they can be defined as substantially rectangular in cross section because they have two opposite straight long sides and two opposite curved short sides. The holes are arranged in a number of rows the long sides of the holes extending in the longitudinal direction of the row and the holes of one row being displaced in relation to the holes in adjacent rows a distance which corresponds to half the pitch of the holes as best seen from FIG. 3. Each second row terminates with a circular blind hole 14**.

When the block described is used for building brickwork, mortar or other adhesive is spread out on the flat side 12*a* arranged as the top side, and when there is positioned on said block another block having the flat side 12*b* wherein the holes 13, 14 open, facing downwards, there is obtained a good adhesion between the blocks.

The cavities provided by the blind holes in the light-weight clinker block contribute to an increase of the heat-insulating quality of the block and also provide a favourable relationship between the weight and the strength when they are arranged in the manner described. The light-weight clinker block can easily be manufactured in simple moulds such mould being combined with pins or similar cores for the formation of the blind holes.

However, the heat-insulating quality of the building block described is further improved by filling the holes 13, 14 with a heat-insulating material, preferably a heat-insulating foamed plastic material. For this purpose it is preferred to use urea-formaldehyde resin such material being filled into the holes in liquid form together with a hardener including a foaming agent to form a substantially rigid foam. Thus, the holes are filled with a stable foam having a low density and a low thermal conductivity. Moreover, such foam is incombustible.

Figure 5:
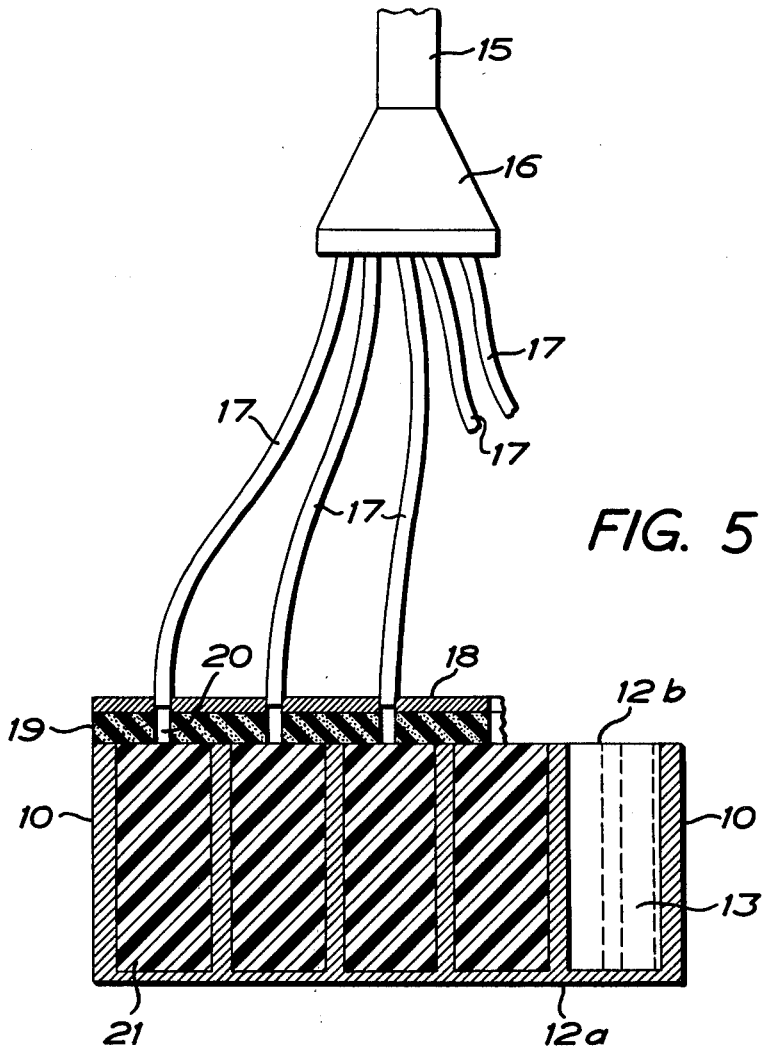
FIG. 5 is a fragmentary vertical sectional view of a nozzle arrangement and a block illustrating the method of filling the holes of the block with heat-insulating plastic material.

Referring to FIG. 5 there is illustrated a method for filling the holes with foaming plastic material. A nozzle 15 which can form part of an equipment as that described in U.S. Pat. No. 4,021,386 is provided with a transition tube 16 to which there is connected a number of flexible tubes or hoses 17. The number of tubes 17 corresponds to the number of holes 13, 14 in the building block described above. The tubes are extended to a plate 18 of wood or iron having a sealing sheet 19 of cellular rubber on the lower side thereof, and are connected to through holes 20 in the plate 18 and the sheet 19, said holes being arranged in a pattern corresponding to that of the holes 13 and 14 of the block to communicate one with each hole when the plate 18 is positioned over the flat side 12*b* of the block when turned upside down to the position shown in FIG. 2. The sheet 19 sealingly engages the flat side 12*b* of the block so that foaming plastic material 21 when supplied to the holes from the nozzle 15 is prevented from escaping from the holes. Thus the material will closely fill the holes of the block.

Figure 6:
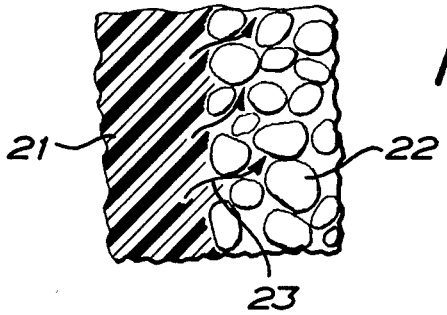
FIG. 6 is an enlarged fragmentary vertical cross sectional view of the block illustrating the penetration of plastic material into interstices in the cement-stabilized granulate.

By suitable grading of the granulate material, i.e. the light-weight clinker material, for example so that the size of the granules ranges from 3 to 8 mm, there are formed interstices between the granules. The volume of these interstices may be about 16% for a granule size of 3 to 8 mm. Thus, when the foaming plastic material is filled into the holes 13 and 14 under light pressure, e.g. 4 kg per $cm^2$, it will penetrate into the cement-stabilized granulate and at least partially, in fact to a great extent, fill said interstices. This is illustrated in FIG. 6 where the granules are shown at 22 and arrows 23 indicate the penetration of the foaming plastic material 21 into the interstices formed by the granules 22.

In an illustrative embodiment of the building block according to the invention the block is manufactured of burnt expanded clay having a granule size ranging substantially from 3 to 8 mm. The granules are stabilized with thin Portland cement mortar. The block body has a length of 490 mm, a width of 290 mm and a height of 190 mm. Each hole 13 having an elongated and substantially rectangular cross sectional form is 79 mm in the longitudinal direction of the row, and the holes are spaced 14 mm in the longitudinal direction of the row. The width of each hole is 27 mm, the short sides of the hole having a radius of curvature which is 13.5 mm. The diameter of the circular holes is 27 mm. There are six rows of holes and the rows are spaced 18 mm. The bottom of each hole has a thickness of 7 mm which means that the depth of each hole is 183 mm. The foamed plastic material filled into the holes is a stable foam of low density and low thermal conductivity made from Aerolite (reg. trade mark) urea-formaldehyde resin and a hardener incorporating foaming agent such foam having been produced and injected into the hole under slight pressure, e.g. as illustrated in FIG. 5. Aerolite resins are manufactured by the Plastics Division, CIBA-GEIGY (UK) Limited.

It has been found that the thermal conductivity $\lambda$ of a building block as described above measured according to Lang in a Lang apparatus is about 0.09 W/m° C. This should be compared with the corresponding value of a solid building block of the same type of burnt expanded clay which ranges from about 0.18 to about 0.22 W/m° C. The urea-formaldehyde foam does not readily transmit water but it is important to note that such foam is not a barrier to water vapor and so permits the escape of water vapor as does the light clinker material which is important as far as building blocks are concerned where used in walls of buildings.

Instead of burnt expanded clay there may be used in the building block according to the invention a natural form of vulcanic material.

It will be apparent to those skilled in the art that various other modifications and variations in addition to those mentioned above could be made in the building block of the invention without departing from the scope and spirit of the invention.

I claim:

1. An improved heat-insulated building block comprising:

a parallelepipedic body of cement-stabilized elastic granulate, said granulate being of a predetermined grade range for forming interstices, and wherein blind holes are formed extending into said body perpendicular from a surface thereof which is intended to be the lower side of the building block when in operative position, said holes being arranged in several rows each of which comprises a plurality of spaced holes; and heat-insulating foam plastic material injected into said holes for filling said holes and for penetration into said formed interstices.

2. A building block as claimed in claim 1 wherein the foam plastic material comprises substantially rigid foamed urea-formaldehyde resin.

3. A building block as claimed in claim 1 wherein the heat-insulating foam plastic material is injected into said holes under pressure.

4. A building block as claimed in claim 1 wherein said granulate grade ranges from 3 to 8 mm to form an interstice volume of approximately 16%, and wherein the building block has a Lang thermal conductivity of approximately 0.09 W/m° C.

* * * * *